US007104263B1

(12) United States Patent
Chen

(10) Patent No.: US 7,104,263 B1
(45) Date of Patent: Sep. 12, 2006

(54) DETERGENT SUPPLY SYSTEM FOR A SELF-CLEANING KITCHEN HOOD

(76) Inventor: Po-Chang Chen, No. 102, Tong-An St., Fongyuan City, Taichung Hsien (TW)

( * ) Notice: Subject to any disclaimer, the term of this patent is extended or adjusted under 35 U.S.C. 154(b) by 0 days.

(21) Appl. No.: 11/115,356

(22) Filed: Apr. 27, 2005

(51) Int. Cl.
*F24C 15/20* (2006.01)

(52) U.S. Cl. ..... 126/299 E; 126/299 D; 126/389.1

(58) Field of Classification Search ..... 126/299 E, 126/299 D, 389.1; 454/49; 55/DIG. 36
See application file for complete search history.

(56) References Cited

U.S. PATENT DOCUMENTS 4,066,064 A * 1/1978 Vandas ..... 126/299 E
4,124,021 A * 11/1978 Molitor ..... 126/299 E
4,351,652 A * 9/1982 Wisting ..... 96/265
4,827,903 A * 5/1989 Kim ..... 126/299 R
5,069,197 A * 12/1991 Wisting ..... 126/299 E
5,359,990 A * 11/1994 Hsu ..... 126/299 E
5,662,097 A * 9/1997 Panos ..... 126/299 E

* cited by examiner

*Primary Examiner*—Cheryl Tyler
*Assistant Examiner*—Michael J. Early
(74) *Attorney, Agent, or Firm*—Rabin & Berdo, P.C.

(57) ABSTRACT

A detergent supply system for a kitchen hood has a mounting case perpendicularly attached to the kitchen hood, a detergent dispenser with a pump, a wastewater collector and a detergent reservoir mounted higher than the detergent dispenser is mounted. By mounting the detergent dispenser, wastewater collector and the detergent reservoir inside the mounting case, the detergent supply system can be conveniently attached to a self-cleaning kitchen hood.

6 Claims, 4 Drawing Sheets

DETERGENT SUPPLY SYSTEM FOR A SELF-CLEANING KITCHEN HOOD

BACKGROUND OF THE INVENTION

1. Field of the Invention

The present invention relates to a detergent supply system for a self-cleaning kitchen hood, and more particularly to a detergent supply system that can be conveniently attached to the self-cleaning kitchen hood.

2. Description of Related Art

A conventional kitchen hood catches and discharges oily smoke from a kitchen with an exhaust fan. However, the fan and wall of the kitchen hood are coated with a sticky oil residue when the kitchen hood is used for a short period. Then, the kitchen hood becomes stinky, and the exhaust efficiency is significantly reduced. To clean the kitchen hood, users have to disassemble the kitchen hood, especially to detach the fan, and reassemble the kitchen hood after cleaning. Therefore, cleaning the kitchen hood is troublesome for the user. Moreover, a technician is needed to reassemble the kitchen hood because the kitchen hood is complicated and easily makes noise when accessories of the kitchen hood are not reassembled properly.

Consequently, kitchen hoods manufacturers developed a self-cleaning kitchen hood that includes a cleaning apparatus with detergent inside the kitchen hood so that the kitchen hood can clean itself when the kitchen hood gets dirty. Because the cleaning apparatus is built into the kitchen hood, the kitchen hood is huge. Additionally, the cleaning apparatus is difficult to access when repairs are required. Because of the foregoing drawbacks, the cleaning apparatus for a kitchen hood cannot be used in many kitchens.

The present invention has arisen to mitigate or obviate the disadvantages of the conventional cleaning apparatus for a kitchen hood.

SUMMARY OF THE INVENTION

The main objective of the present invention is to provide a detergent supply system that can be conveniently used with a conventional self-cleaning kitchen hood.

Further benefits and advantages of the present invention will become apparent after a careful reading of the detailed description with appropriate references to the accompanying drawings.

DETAILED DESCRIPTION OF THE PREFERRED EMBODIMENT

A detergent supply system in accordance with the present invention for a self-cleaning kitchen hood having detergent distribution, collection and drain pipes and detergent spray nozzles comprises a mounting case, a detergent dispenser, a wastewater collector and a detergent reservoir. The mounting case is attached perpendicularly to the kitchen hood. The detergent dispenser has a pump. The detergent reservoir is mounted higher than where the detergent dispenser is mounted. By mounting the detergent dispenser, the wastewater collector and the detergent reservoir inside the mounting case, the detergent supply system can be conveniently attached to the self-cleaning kitchen hood to substitute for a conventional built-in cleaning apparatus in accordance with the prior art.

Figure 1:
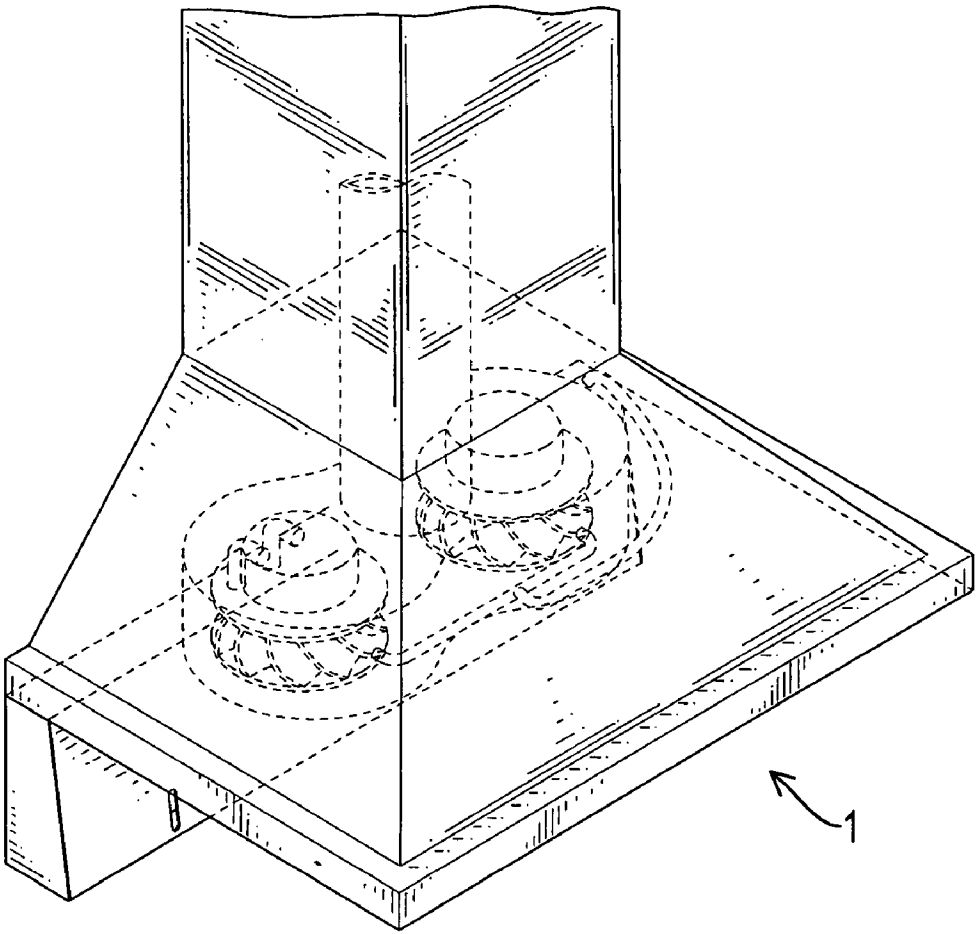
FIG. 1 is a perspective view of a self-cleaning kitchen hood with a detergent supply system in accordance with the present invention mounted in the self-cleaning kitchen hood.
Figure 2:
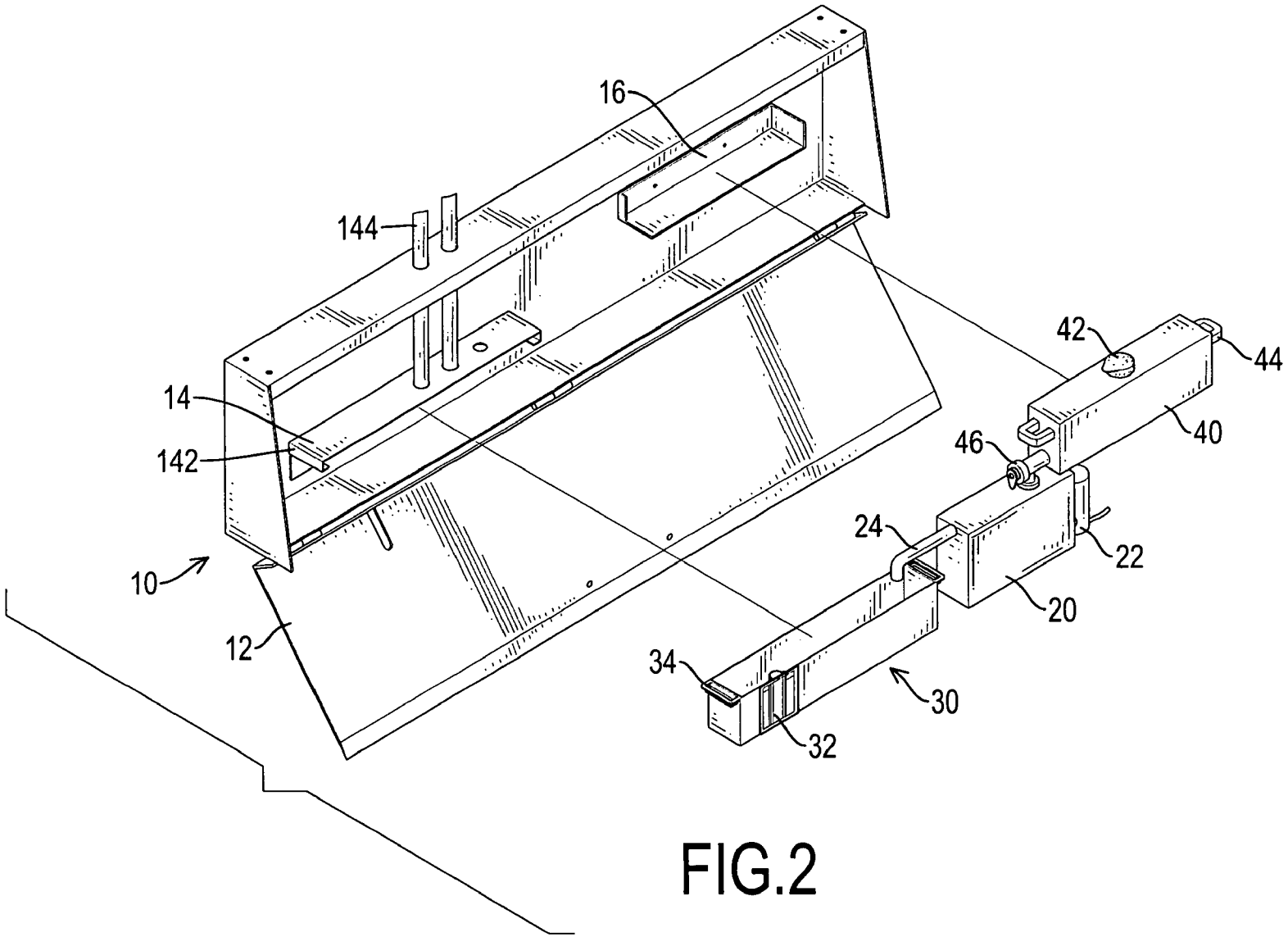
FIG. 2 is a partially exploded perspective view of part of the self-cleaning kitchen hood and the detergent supply system in FIG. 1.
Figure 3:
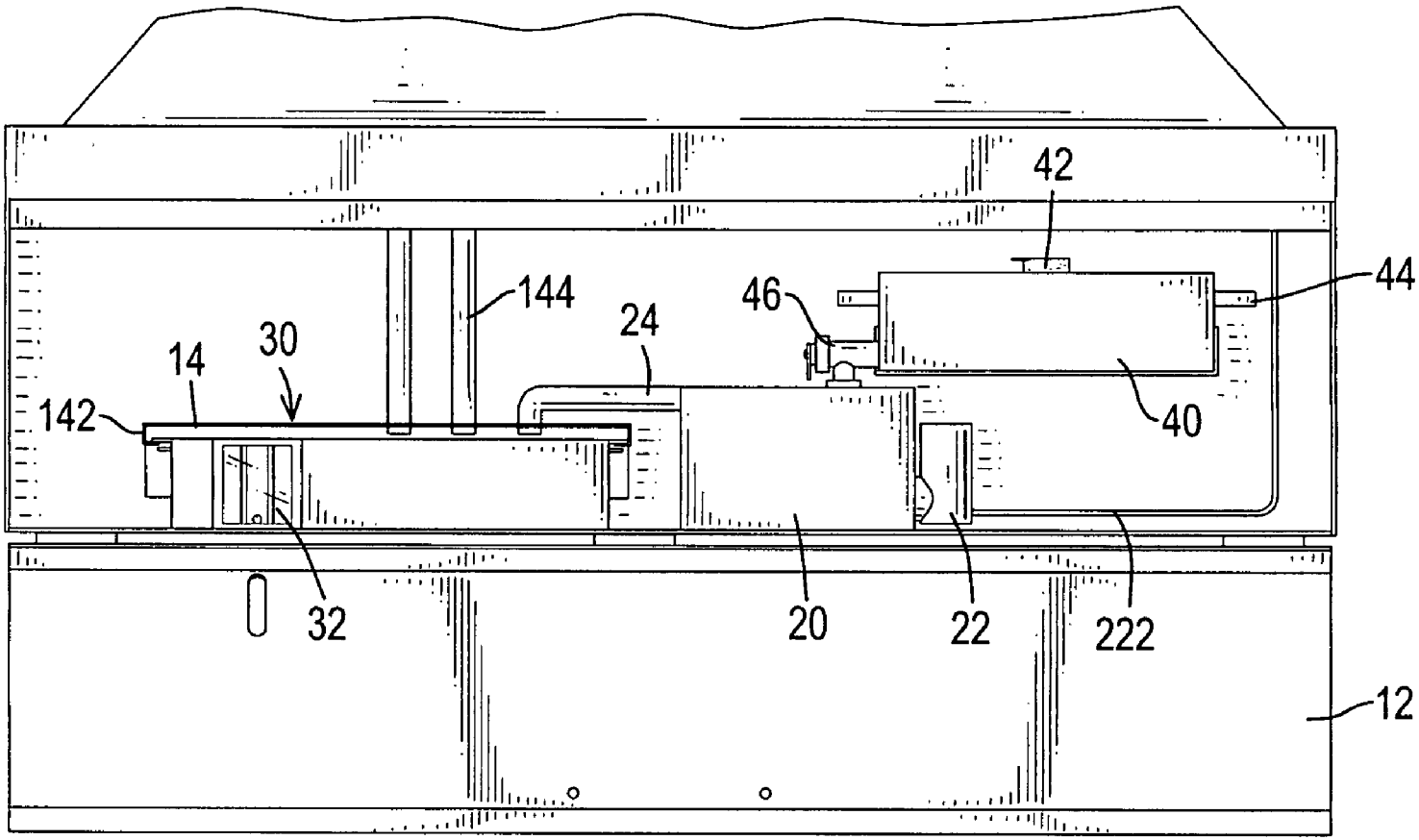
FIG. 3 is a front view of the self-cleaning kitchen hood and detergent supply system in FIG. 2.

With reference to FIGS. 1 to 3, the preferred embodiment of the detergent supply system is attached to a kitchen hood (1) and comprises a mounting case (10), a detergent dispenser (20), a wastewater collector (30) and a detergent reservoir (40).

The mounting case (10) is a rectangular flat box and comprises a top, a bottom, an outer wall, an inner opening, an interior, an access panel (12), a hanging rack (14), at least one drainpipe (144) and a bracket (16). By attaching the top of the mounting case (10) to the kitchen hood (1) with screws, the detergent supply system can be conveniently attached to or detached from the kitchen hood (1).

The access panel (12) is pivotally attached to the bottom of the mounting case (10) to close the inner opening.

The hanging rack (14) is attached to the outer wall near the bottom inside the interior of the mounting case (10) and may have a top, two ends and two hooks (142). The hooks (142) are formed respectively at the ends.

The at least one drainpipe (144) is mounted perpendicularly through the top of the mounting case (10) and the hanging rack (14) and connects to the collection and drain pipes of a cleaning apparatus.

The bracket (16) is attached to the outer wall inside the interior near the top of the mounting case (10).

The detergent dispenser (20) is mounted on the bottom inside the interior of the mounting case (10), is a parallelepiped box and has a top, a bottom, two ends, a pump (22) and an optional overflow pipe (24). The pump (22) is connected to one end of the detergent dispenser (20), communicates with the detergent dispenser (20) and has a discharge tube (222). The discharge tube (222) extends from the pump (22) and connects to distribution pipes in the self-cleaning kitchen hood. The overflow pipe (24) is attached to the other end of the detergent dispenser (20).

The wastewater collector (30) is detachably attached to the hanging rack (14) under the at least one drainpipe (144) and the overflow pipe (24) of the detergent dispenser, may be a rectangular sink and may have a top opening, a front face, two ends, a level-monitoring device (32) and two ears (34).

Figure 4:
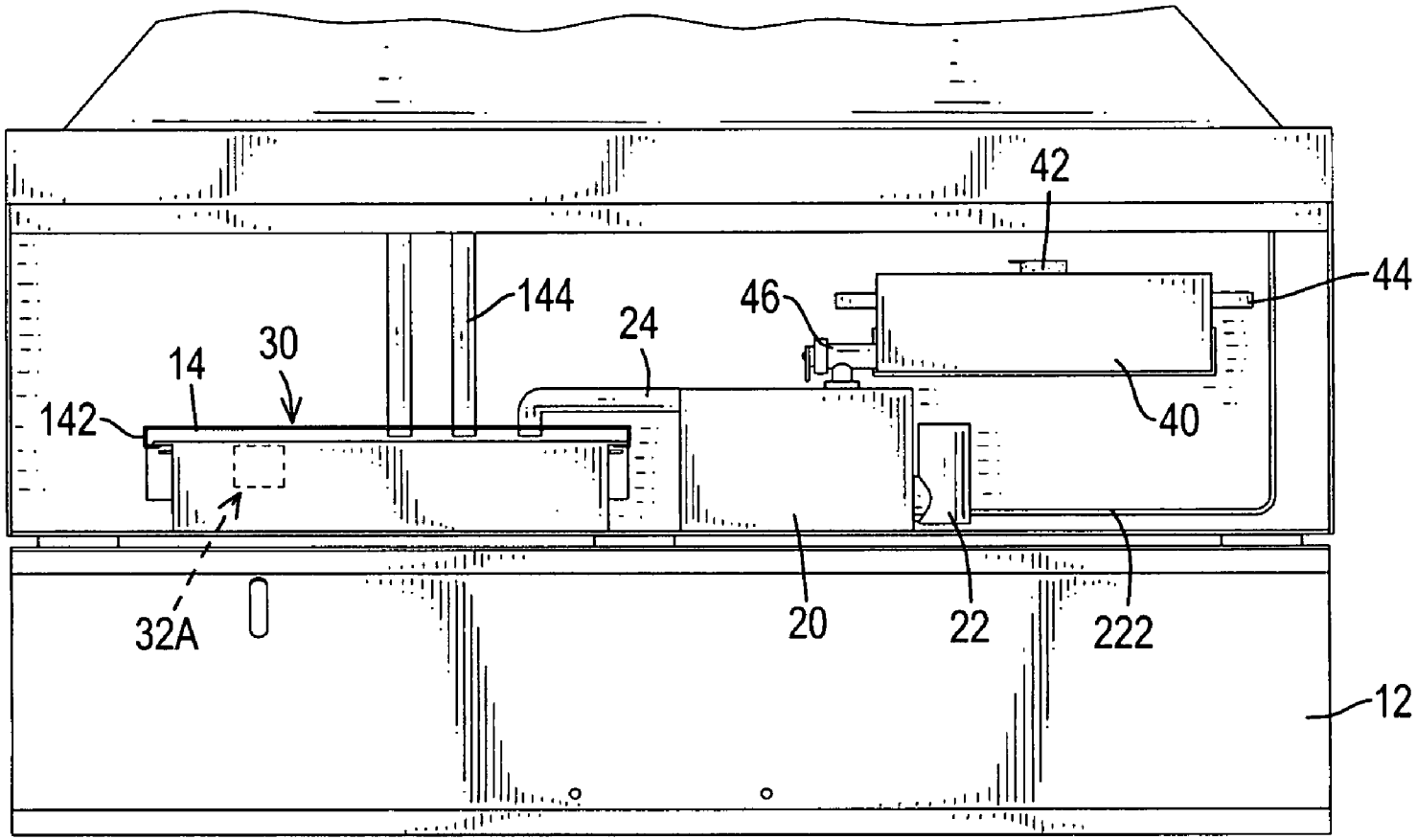
FIG. 4 is a front view of the self-cleaning kitchen hood and another embodiment of the detergent supply system in accordance with the present invention.

The level-monitoring device (32) is mounted on the front face of the wastewater collector (30) to show how much wastewater is inside the wastewater collector (30). With reference to FIG. 3, the level-monitoring device (32) may be a sightglass with a float ball to clearly show the surface level of the wastewater in the wastewater collector (30). With reference to FIG. 4, another preferred embodiment of the level-monitoring device (32A) is an electronic detector that electrically connects to the pump (22) to disable the pump (22) to keep the wastewater collector (30) from overflowing.

The two ears (34) are formed respectively at the ends of the wastewater collector (30) to engage the hooks (142) on the hanging rack (14).

The detergent reservoir (40) is mounted on the bracket (16) to make the detergent reservoir (40) higher than the detergent dispenser (20) so that detergent will automatically flow from the detergent reservoir (40) to the detergent dispenser (20) because of gravity. The detergent reservoir (40) is a rectangular box and has a top, two ends, an inlet (42), two handles (44), a discharge tube and a discharge valve (46). The inlet (42) is defined in the top of the detergent reservoir (40) through which detergent is poured into the detergent reservoir (40). The two handles (44) are formed respectively at the ends of the detergent reservoir (40) so that the detergent reservoir (40) can be removed conveniently from the bracket (16). The discharge tube is mounted through the end near the detergent dispenser (20) and communicates with the detergent dispenser (20) to allow detergent to flow from the detergent reservoir (40) into the detergent dispenser (20). The discharge valve (46) is mounted in the discharge tube to control detergent flowing from the detergent reservoir (40).

When the detergent supply system operates, detergent flows from the detergent reservoir (40) into the detergent dispenser (20). In the detergent dispenser (20), the detergent is pumped to self-cleaning apparatus of the kitchen hood (1) through the discharge tube (222) and sprays on fans through nozzles to remove oil and oil residue. Then, the wastewater is collected in an annular gutter around the kitchen hood (1) and drained out of the kitchen hood (1) through the drainpipes (144) to the wastewater collector (30). When the wastewater collector (30) is full of the wastewater, the wastewater collector (30) is detached from the hanging rack (14) and the wastewater is poured out.

The detergent supply system has the following advantages:

1. By mounting the wastewater collector (30), the detergent dispenser (20) and the detergent reservoir (40) inside the mounting case (10), the entire detergent supply system can be conveniently attached to the self-cleaning kitchen hood (1) to clean the self-cleaning kitchen hood (1).

2. Each element in the detergent supply system is isolated and detachable from the mounting case (10) so that repair and cleaning of individual elements of the system are easy and convenient.

Although the invention has been explained in relation to its preferred embodiments, many other possible modifications and variations can be made without departing from the spirit and scope of the invention as hereinafter claimed.

What is claimed is:

1. A detergent supply system for a kitchen hood having distribution pipes, collection pipes, drain pipes and spray nozzles, the detergent supply system comprising:

a mounting case having
- a top;
- a bottom;
- an outer wall;
- an inner opening;
- an interior;
- an access panel pivotally attached to the mounting case to close the inner opening;
- a hanging rack attached inside the interior of the mounting case, and having
  - a top;
  - two ends; and
  - two hooks formed respectively at the ends;
- at least one pipe mounted through the mounting case and the hanging rack and adapted to connect to drain pipes in the kitchen hood; and
- a bracket attached inside the interior of the mounting case;

a detergent dispenser mounted on the interior of the mounting case and having
- a top;
- a bottom;
- two ends; and
- a pump connected to one end of the detergent dispenser, communicating with the detergent dispenser and having a discharge tube extending from the pump and adapted to connect to distribution pipes in the self-cleaning kitchen hood;

a wastewater collector that is a rectangular sink, and being detachably attached to the hanging rack under the at least one drainpipe, said wastewater collector comprising:
- a top opening;
- a front face;
- two ends; and
- two ears formed respectively at the ends of the wastewater collector to engage the hooks on the hanging rack; and a detergent reservoir detachably mounted on the bracket and having
- a discharge tube communicating with the detergent dispenser; and
- a discharge valve mounted in the discharge tube.

2. The detergent supply system as claimed in claim 1, wherein the detergent dispenser further has an overflow pipe attached to the other end of the detergent dispenser and communicating with the wastewater collector.

3. The detergent supply system as claimed in claim 1, wherein the detergent reservoir is a rectangular box and has
- a top;
- two ends;
- an inlet defined in the top of the detergent reservoir; and
- two handles formed respectively at the two ends of the detergent reservoir.

4. The detergent supply system as claimed in claim 3, wherein the wastewater collector further has a level-monitoring device attached to the front face of the wastewater collector.

5. The detergent supply system as claimed in claim 4, wherein the level-monitoring device is a sight glass with a float ball indicator.

6. The detergent supply system as claimed in claim 4, wherein the level-monitoring device is an electronic detector that electrically connects to the pump.

* * * * *